United States Patent [19]

Brown et al.

[11] Patent Number: 4,796,167

[45] Date of Patent: Jan. 3, 1989

[54] LOCUS IDENTIFYING DEVICE

[75] Inventors: Thomas A. Brown, San Jose; Kirk A. Martin, Aptos, both of Calif.

[73] Assignee: Kat Electronics, Inc., Los Gatos, Calif.

[21] Appl. No.: 130,150

[22] Filed: Dec. 8, 1987

[51] Int. Cl.[4] ..... F21V 31/00

[52] U.S. Cl. ..... 362/158; 362/202; 362/253; 116/DIG. 7

[58] Field of Search ..... 362/158, 202, 253; 346/568, 571, 604; 116/DIG. 7, 202; 455/98; 43/17.6

[56] References Cited

U.S. PATENT DOCUMENTS

| | | | |
|---|---|---|---|
| 2,539,403 | 1/1951 | Grim et al. | 362/158 X |
| 2,558,870 | 7/1951 | Michelman | 362/158 X |
| 2,765,481 | 10/1956 | Manhart et al. | 362/158 X |
| 2,971,081 | 2/1961 | Shimizu | 362/158 |
| 3,292,039 | 12/1966 | Horino et al. | 315/159 |
| 3,384,781 | 5/1968 | Holle | 362/158 X |
| 3,559,224 | 2/1971 | Shimizu | 362/158 X |
| 3,940,868 | 3/1976 | Northcutt | 43/17.6 |
| 4,070,784 | 1/1978 | Yokogawa et al. | 362/158 X |
| 4,077,076 | 3/1978 | Masters . | |
| 4,242,724 | 12/1980 | Stone | 362/158 |
| 4,464,129 | 8/1984 | Vancheri et al. . | |
| 4,475,476 | 10/1984 | Howard . | |

FOREIGN PATENT DOCUMENTS

| | | | |
|---|---|---|---|
| 449736 | 7/1936 | United Kingdom | 43/17.6 |

*Primary Examiner*—Ira S. Lazarus
*Assistant Examiner*—Richard R. Cole
*Attorney, Agent, or Firm*—Flehr, Hohbach, Test Albritton & Herbert

[57] ABSTRACT

A water activated locus identifying device for attachment to articles apt to be lost in a body of water wherein the water activation serves to operate an electric light thereby making the locus of the article more easily identified.

7 Claims, 4 Drawing Sheets

LOCUS IDENTIFYING DEVICE

This invention pertains to a water activated locus identifying device such as a light attachable to an article difficult to locate when disposed in a body of water.

Heretofore, as is known to most boatmen, those who may have lost their keys in the water, the task of finding them usually has been rather difficult. This is especially difficult at night when no sunlight will be reflected from the keys lying on the bottom. The same problem exists with the loss of a tackle box, or other non-buoyant article.

In yet another situation, it is known that locating a swimmer or life raft in the open ocean is hampered by the presence of peaks and troughs of waves rolling thereacross.

As disclosed herein, an aid for attachment to sinkable or floatable articles is provided which includes a light and means for actuating the light in response to submergenge of part of the aid in a conductive fluid, such as water.

SUMMARY OF THE INVENTION AND OBJECTS

In general, a water activated locus identifying device is adpated to be coupled to an article to aid in locating such article, the device comprises a hollow sealed container, an electric light is carried by the container, and an electric circuit means supported within the container and coupled to operate the light. The circuit means includes a pair of spaced leads extending out of the container and disposed in the circuit means to energize the light when coupled electrically together by immersion into a body of conductive fluid, such as water.

It is a general object of the present invention to provide an improved locus identifying device or assembly primarily intended for use on the water to be activated by immersion therein.

It is a further object of the invention to provide such a device having positive buoyancy whereby the device rises to the surface of the water as a float does.

It is yet another object of the invention to provide a device as noted above characterized by concentric spaced cylindrical bodies providing a gap therebetween for containing a sheet of identifying information.

The foregoing and other objects of the invention will become more readily evident when considered in conjunction with the following detailed description of preferred embodiments when explained with respect to the following drawing figures.

DETAILED DESCRIPTION OF PREFERRED EMBODIMENTS

Figure 1:
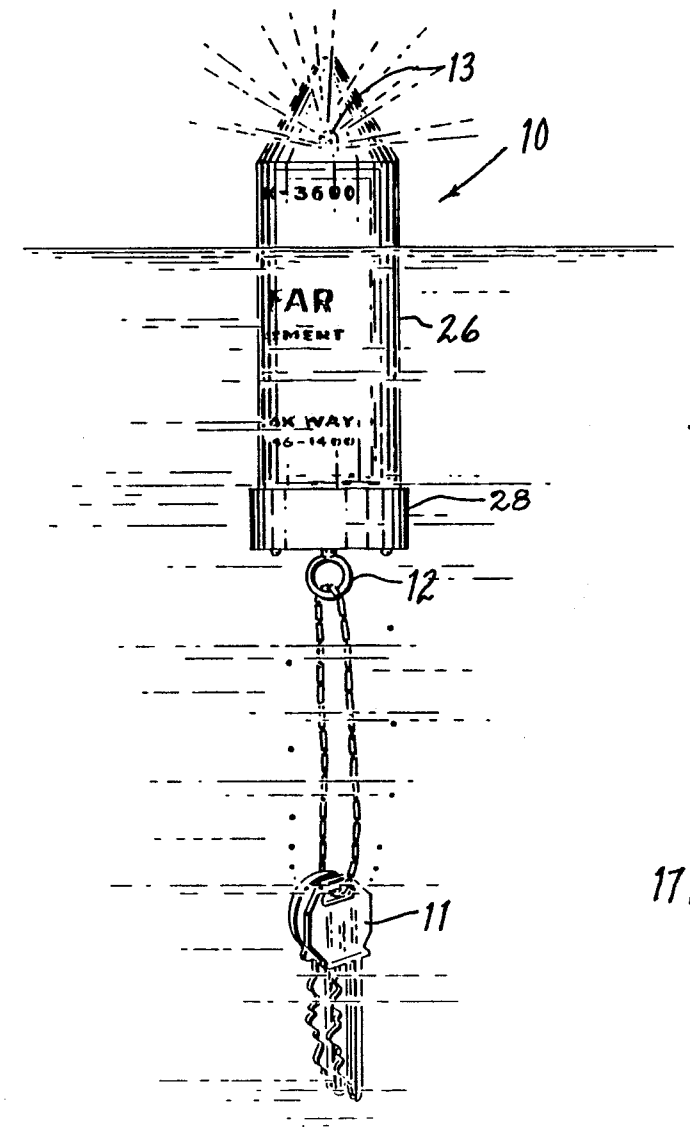
FIG. 1 shows a side elevation view according to the invention floating in a body of water.
Figure 4:
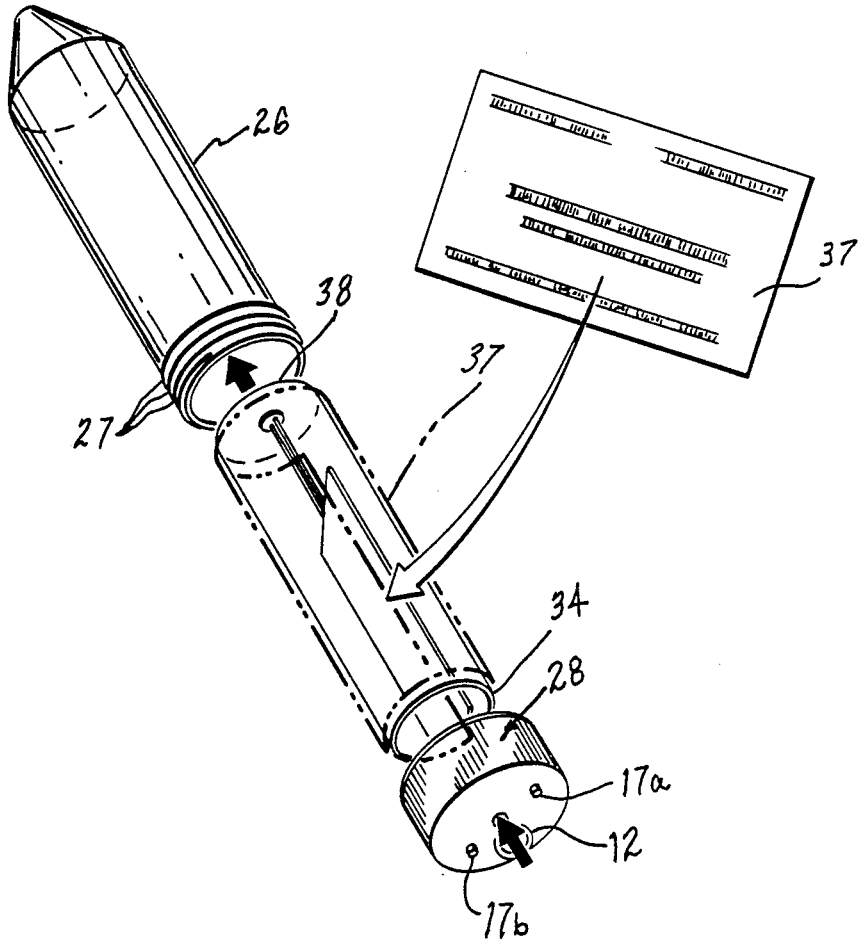
FIG. 4 shows a diagrammatic exploded perspective view according to the invention.

According to the embodiment shown in FIG. 1 a unit 10 of a type intended for use in conjunction with a boat operator's keys 11 has been constructed to have positive buoyancy so that it will float and support the keys depending from an eyelet 12 carried at the bottom thereof. The upper end of embodiment 10 is provided with a transparent conically shaped end whereby light from a flashing light emitting diode 13 can be readily seen.

Figure 3:
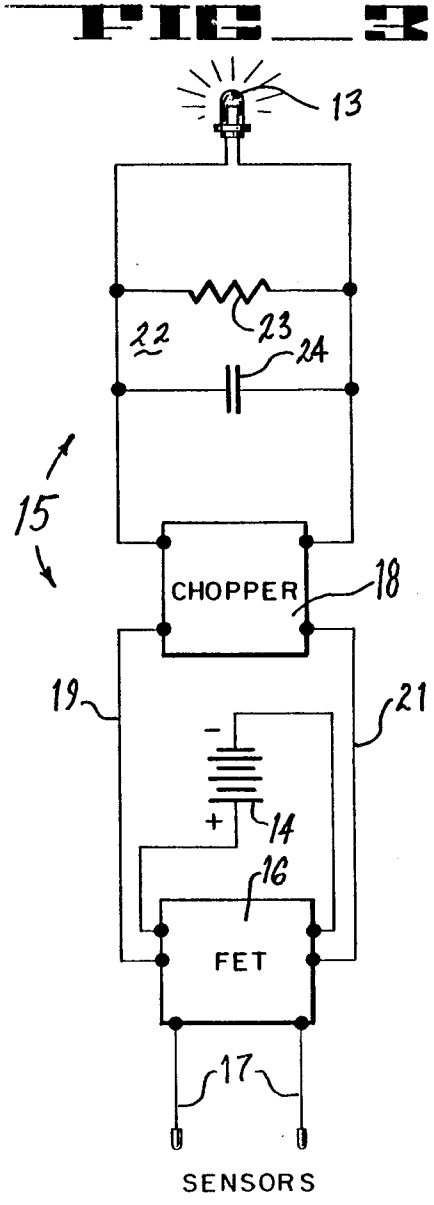
FIG. 3 shows a diagrammatic view of a circuit for use in conjunction with the invention as shown in FIGS. 1 and 2.

A water activated circuit 15 as shown in FIG. 3 comprises a battery 14 coupled across a field effect transistor 16 provided with a pair of spaced apart sensors 17 or conductive portions of circuit 15. A chopper 18 having a timing aspect thereto is also connected across transistor 16 by leads 19, 21. The output side of chopper 18 activates an LED 13 and includes a tank circuit 22 consisting of a resistor 23 and a capacitor 24. By disposing both of the sensors 17 into a conductive body of fluid such as the body of water shown, a dead short will be formed across a portion of the FET 16. By providing such a short the timer in the chopper will commence and the LED 13 will flash on and off at a given rate depending upon the duty cycle established.

Figure 2:
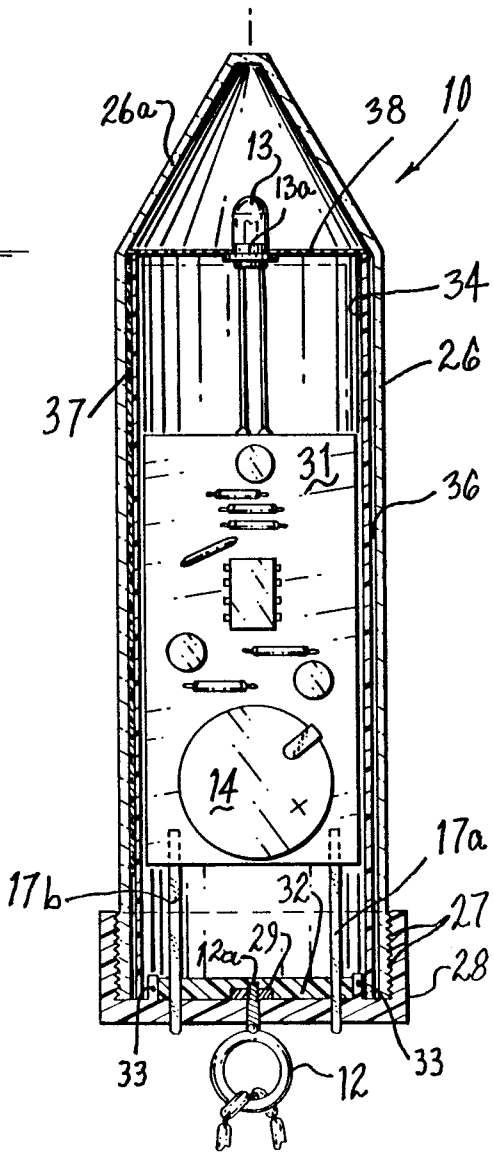
FIG. 2 shows a side elevation section view of the locus identifying unit of FIG. 1 according to the invention.

As shown in FIG. 2 device 10 comprises a generally cylindrical outer body 26 formed with a transparent conical upper end 26*a* and a series of male threads 27 formed at the lower end of body 26. Threads 27 serve to engage the female threads formed interiorly of the cap 28.

An eyelet 12 includes a threaded stem screwed through the bottom of cap 28 and retained on its inner end by means of a suitable dog 29.

Circuit 15 described above is carried on a printed circuit board 31.

The inside of cap 28 includes a layer 32 of insulation material serving to bind the downwardly depending ends of support elements 17*a*, 17*b* represented in FIG. 3 as the sensors 17. Elements 17*a*, 17*b* are sufficiently rigid to support the printed circuit board 31 and extend downwardly therefrom through the layer 32 to pass through associated small openings formed in the end of cap 28.

The purpose of layer 32 is to provide insulation between sensors 17 to permit the cap to be made of a metallic substance to preclude a shortcircuit directly at that point. In addition the layer 32 provides an adhesive material whereby the support elements 17*a*, 17*b* can be readily engaged, and their respective cap openings sealed.

Further, whenever the bottom end of unit 10 is disposed in water, a connection is made between the protruding tips of support elements 17*a*, 17*b* to complete a circuit therebetween thereby activating the circuit described in FIG. 3.

In addition to the above, the inner side of cap 28 is formed to include an annular wall 33 coaxially thereof whereby an elongate cylindrical body 34 can be carried upwardly into outer body 26 in coaxially spaced relation. The spacing or gap 36 therebetween serves to receive a business card 37 interposed between the outside of the inner wall or cylindrical body 34, and the inside of the outer body 26. In this way identification as to ownership of the keys can be readily identified by the finder.

Finally, a reflective sheet of stiff material 38 includes a central opening therein adapted to ride upon the flange 13*a* of LED 13. In addition, the outer perimeter of sheet 38 is carried by the upper end edge of body 34.

Accordingly, when the cap 28 has been screwed fully into place, cap 28 urges body 34 upwardly to the point of initial convergence of the top of unit 10. Location of the mirror 38 behind LED 13 serves to provide a certain degree of amplification of light therefrom.

Figure 9:
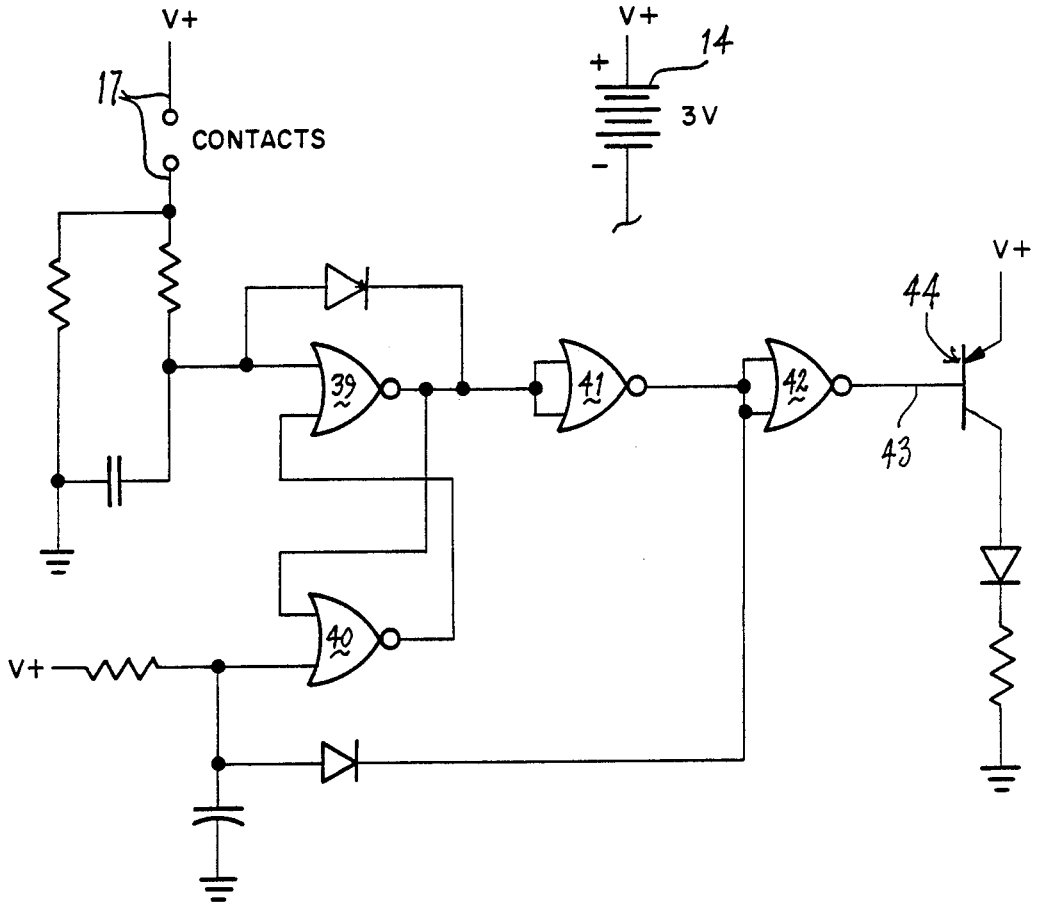
FIG. 9 shows a schematic circuit diagram for use in conjunction with the embodiment shown in FIG. 1.

Finally, with regard to the embodiment shown in FIG. 1 and the circuit shown in FIG. 3 therefor, a detailed construction of a circuit suitable for use in the foregoing embodiment has been provided in detail in FIG. 9 employing a group of four NOR gates 39, 40, 41 and 42 serving to control the potential on base electrode 33 for operating transistor 44 whereby immersion of contacts 17 into the water serves to apply a voltage to the circuit and ultimately to base electrode 43 whereby transistor 44 is driven into a conductive state.

The foregoing embodiment is particularly useful in conjunction with providing protection against the loss of keys or as it may be attached to a bait box by means of a cord or string or other suitable small articles which need to be handled onto and off of a small boat whereby they can be knocked into the water or otherwise lost in the water.

Figure 5:
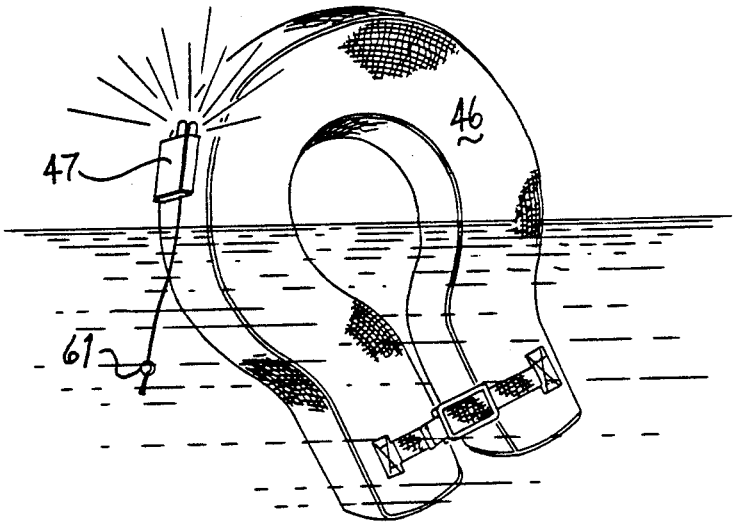
FIG. 5 shows a diagrammatic perspective view of a life vest according to another embodiment of the invention.
Figure 6:
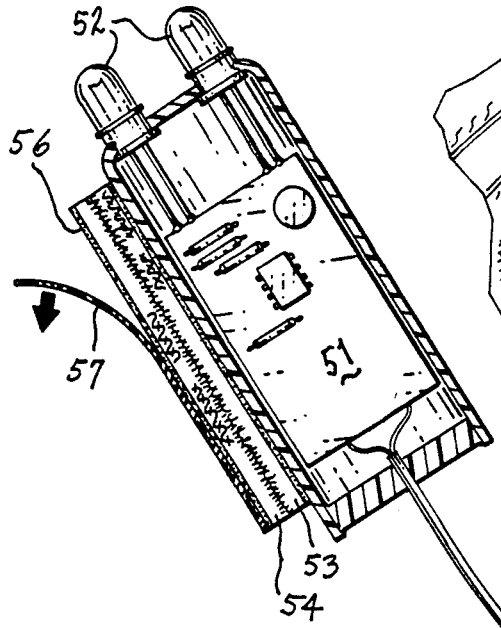
FIG. 6 shows a side elevation section view of a unit as used in conjunction with the life vest in FIG. 5 and taken along line 6—6 of FIG. 7.
Figure 7:
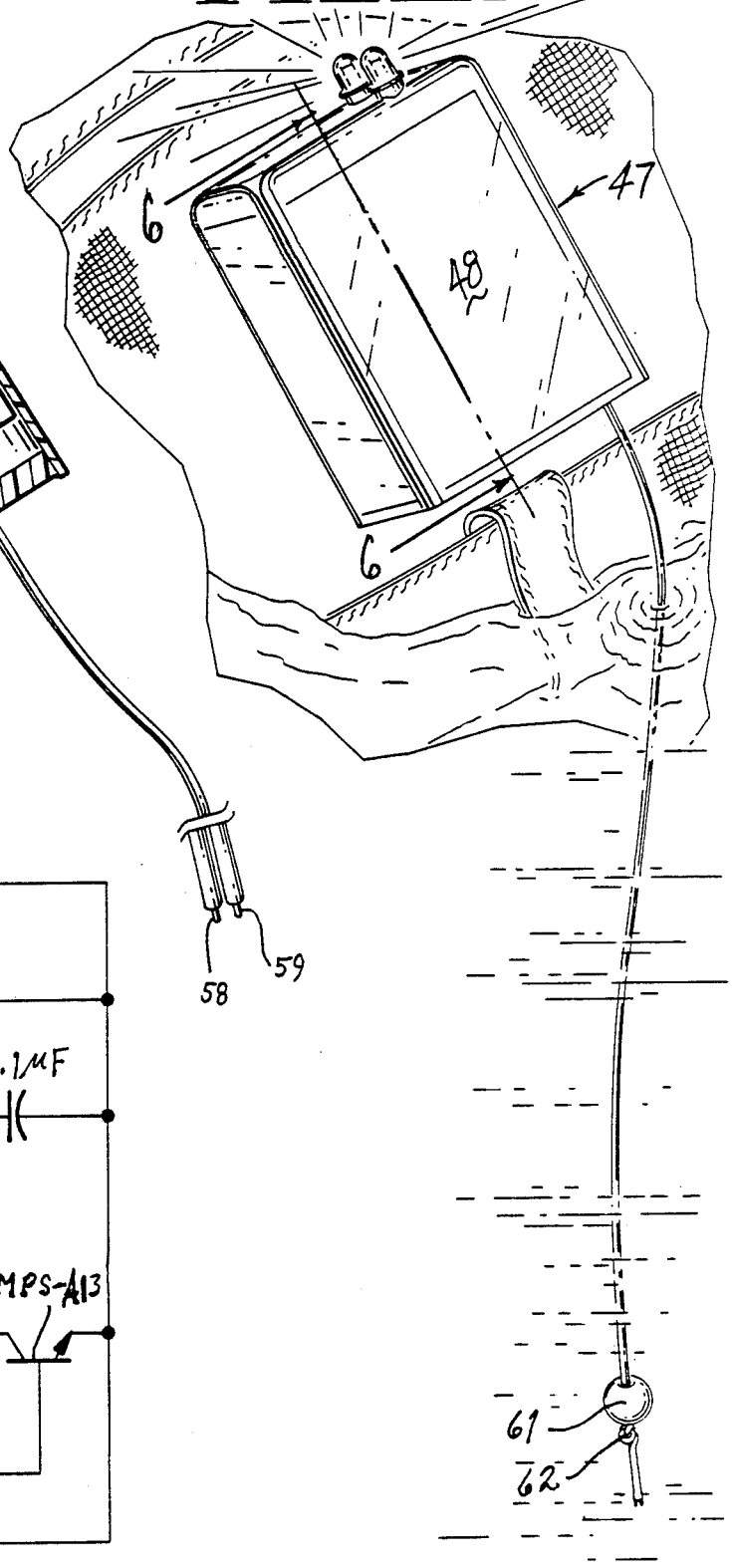
FIG. 7 shows in enlarged detail a diagrammatic perspective view of the unit shown in FIG. 5 attached to the life vest.

According to another embodiment as shown in FIG. 5, a water activated locus identifying device of a type adapted to be to attached to an article such as a life vest, life raft, or the like includes means for retaining the container to an article or articles of a type that would be difficult to find in the water, whereby energizing the light in the water makes locating the article much easier. Thus, as shown in FIG. 5 a life vest 46 is diagrammatically shown carrying a water activated locus identifying unit 47 thereon. Unit 47 is shown best in FIGS. 6 and 7. Unit 47 comprises a formed container 48 open on its underside as shown in FIG. 7 for receiving a 9 volt battery 49 (FIG. 8) therein.

Figure 8:
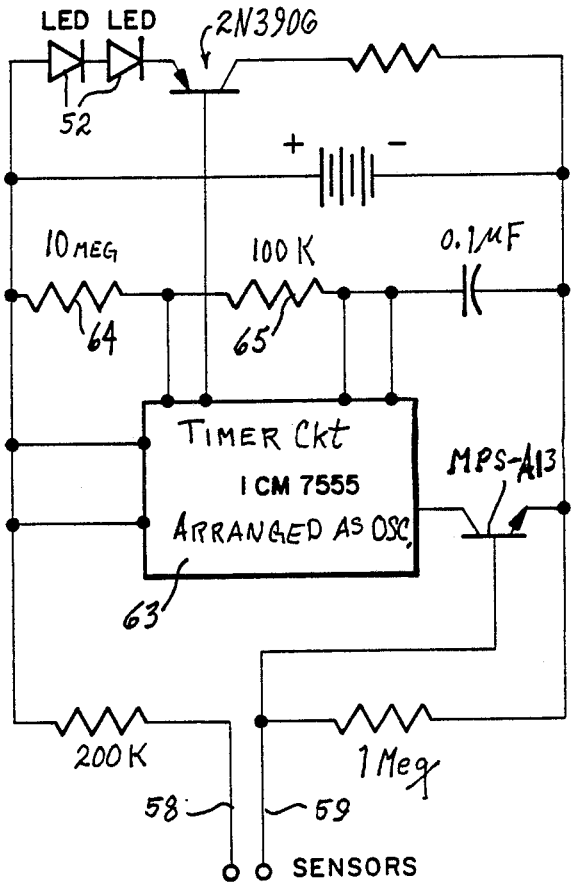
FIG. 8 shows a diagrammatic electrical circuit schematic for use in association with the embodiment disclosed in FIG. 5.

The printed circuit board 51 carries a circuit of a type shown in FIG. 8 for activating each of a pair of LED elements 52. Unit 47 carries a pair of layers 53, 54 of interactive material such as that sold under the registered trademark VELCRO®. Layer 54 further carries a thin layer of adhesive material 56 protected by a thin peelable sheet of wax paper 57.

Once the circuit 51 has been installed and connected to the LED elements 52, the open bottom end can be sealed by a suitable material such as an epoxy resin or the like (not shown). Then, in order to attach unit 47 to the life vest 46, it is necessary simply to peel off the protective paper 57 and apply the exposed adhesive layer 56 to an "appropriate" portion of life vest 46 or to a life raft.

With regard to the term "appropriate" it is to be noted that the pair of sensors 58, 59 should extend downwardly far enough from unit 47 to permit them to readily enter the water. As shown in more particular detail in FIG. 7, a weight 61 has been disposed upon the elongate pair of electrical leads and maintained thereon by tying a knot 62 therebeneath. In this way, the exposed lead ends will fall directly downwardly from unit 47 and activate the timer circuit 63 which is arranged in the form of an oscillator whereby immersion of leads 58, 59 into the water forms substantially a dead short therebetween. The duty cycle is controlled by the relative value of the resistance 64, with regard to resistance 65.

Accordingly, once the sensors leads 58, 59 are immersed into water, such as salt water, the timer circuit 63 will be operated preferably on an alternating basis as indicated by the type of oscillator shown.

Unit 47 has been primarily provided for use in conjunction with attachment to a life vest or to a life raft or the like which will provide sufficient positive buoyancy to maintain unit 47 afloat and with sufficiently bright lights whereby the person wearing the life jacket or in the life raft will be more easily spotted.

I claim:

1. A water activated locus identifying device adapted to be coupled to an article to aid in locating such article, said device comprising a hollow sealed container, a cap threaded onto one end of said container to seal same and capture air therein to cause said container to float when disposed in a body of water, an electrically operated light carried by said container, electric circuit means within said container and coupled to said light, said circuit means including a pair of spaced leads extending out of said container and disposed in said circuit means to energize said light when coupled together by immersion into a body of conductive fluid such as water, said spaced leads supporting said circuit means from said cap and disposed within said container.

2. A water activated device as in claim 1 in which said container includes means for retaining said container to an article or articles of a type that would be difficult to find in the water, whereby energizing said light in water makes locating said article much easier.

3. A water activated locus identifying assembly of positive buoyancy comprising a transparent container formed with threads at one end and closed at the other end, an electric light carried in said other end, electric circuit means coupled to operate said light, a threaded cap carried by said threads at said one end and serving to seal said one end to capture air within said container to provide said positive buoyancy, said cap carrying an interior layer of insulation material, a pair of conductive supports having exterior ends thereof passing through said cap and said insulation material to the surrounds at one end thereof and coupled into said circuit means in a manner forming an open circuit between the exterior ends thereof but being interconnected when disposed into a conductive body of fluids such as water.

4. An assembly as in claim 3 in which said conductive supports further serve to support said circuit means to be carried by said cap.

5. An assembly as in claim 3 including a sheet of reflective material formed with an opening therethrough, a flange formed about said electric light for engaging the edge margin surrounding said opening for supporting said sheet thereon to dispose the outer edge margin at the upper end of said container.

6. An assembly as in claim 5 comprising an elongate cylindrical body carried by said cap to extend substantially coaxially of said container, the upper end edge of said cylindrical body serving to support the periphery of said sheet when the upper end edge of said cap has been screwed into place.

7. An assembly as in claim 3 comprising an elongate cylindrical body carried by said cap and closely spaced coaxially within said container to define an annular space therebetween designed and adapted to contain a sheet of material imprinted with identification of the owner of said assembly.

* * * * *